United States Patent [19]

Vartan

[11] Patent Number: 4,910,894

[45] Date of Patent: Mar. 27, 1990

[54] GARMENT PRESS WITH EXPANDABLE BUCK AND PRESSING PLATE

[76] Inventor: Henri Vartan, 135 Seminary Dr. - Apt. C, Mill Valley, Calif. 94941

[21] Appl. No.: 243,892

[22] Filed: Sep. 13, 1988

[51] Int. Cl.[4] ..... D06F 71/00

[52] U.S. Cl. ..... 38/30; 38/26; 38/36; 38/42; 38/71; 38/104; 38/135; 38/136

[58] Field of Search ..... 100/295, 918, 214, 226; 38/25, 15, 108, 16, 64, 17, 20, 27, 30, 31, 32, 33, 34, 35, 36, 37, 71, 103, 104, 107, 135, 136, DIG. 1, DIG. 2, 112, 26, 28, 42, 112, 137, 111; 223/52.1, 52.2, 52.3, 52

[56] References Cited

U.S. PATENT DOCUMENTS

| | | | |
|---|---|---|---|
| 137,100 | 3/1873 | Sawyer | 38/30 |
| 192,230 | 6/1877 | Chelini | 38/136 |
| 1,923,494 | 8/1933 | Manchester | 38/30 |
| 2,287,646 | 6/1942 | Steele | 38/104 X |
| 2,648,146 | 8/1953 | Foster | 38/30 |
| 2,688,812 | 9/1954 | Foster | 38/30 |
| 3,571,550 | 3/1971 | Rose | 100/226 X |
| 3,699,673 | 10/1972 | Foster et al. | 38/104 X |
| 4,317,358 | 3/1982 | Yonezawa et al. | 100/918 X |
| 4,666,387 | 5/1987 | Yokota et al. | 100/918 X |
| 4,689,905 | 9/1987 | Vantan | 38/71 X |
| 4,817,309 | 4/1989 | Frank et al. | 38/15 |

FOREIGN PATENT DOCUMENTS

| | | | |
|---|---|---|---|
| 824938 | 1/1952 | Fed. Rep. of Germany | 38/107 |

*Primary Examiner*—Andrew M. Falik

*Attorney, Agent, or Firm*—Flehr, Hohbach, Test, Albritton & Herbert

[57] ABSTRACT

In a press wherein an expandable buck and a heated pressing plate are utilized, provision is made for the expansion of the buck without interrupting the overall press finish of garments of varying dimension. The expandable buck includes a thickened longitudinally extending central buck member and two side members. These two side members telescope outwardly from the central buck member. In operation, a garment such as a shirt is passed over the expandable buck. The buck is then expanded at the side members until the garment at its full girth is stretched over the buck. The pressing plate is configured to coact with the buck. It includes an indentation that is configured to coact with the central buck member and thus effect pressing of that portion of the full girth of the garment that overlies the central buck member. It further includes side pressing surfaces designed for cooperative engagement at the expandable sides of the buck protruding beyond the central member. These side surfaces cooperatively press that portion of the garment which happens to overlie the expanded outwardly telescoped side members. The buck is reversible with respect to the pressing plate and symmetrically configured to coact with the pressing plate on both sides. Consequently, the uninterrupted pressing herein disclosed occurs on both sides of the garment to be pressed. Provision is made for the entire apparatus to be mounted flush to a wall.

12 Claims, 3 Drawing Sheets

GARMENT PRESS WITH EXPANDABLE BUCK AND PRESSING PLATE

BACKGROUND OF THE INVENTION

This invention relates to presses. More particularly, this invention relates to a press including an easily removable and interchangeable expandable solid buck, and a cooperating pressing plate configured for coaction with the buck to provide a continuous press of a garment even when the buck is in its expanded position. The entire press may be configured as a collapsible wall unit or as a free standing floor unit.

The concept of a longitudinally rotatable buck coacting with a pressing plate is set forth in my previous U. S. Pat. No. 4,689,905, issued Sept. 1, 1987 and entitled Collapsible Laundry Press. In this earlier patent I disclose a rotatable, expandable buck which coacts with a pressing plate to press a garment.

The concept of using an expandable buck can be simply stated. A garment, such as a man's shirt, is typically at least partially buttoned and treaded over the rotatable buck. The buck is then expanded so as to occupy the full girth of the garment. The pressing plate then coacts with the buck to press the garment.

Unfortunately, in the expanding bucks of the prior art, my own buck included, the surface is uneven at the intersection of the expandable and fixed portions of the buck. This unevenness creates an essentially unpressed area of the garment. While such an unpressed area is not completely fatal to the desired press appearance of the garment, it is undesired.

It is the purpose of this invention to do away with the difficulty encountered.

Expandable bucks are known which are pneumatically inflated. Such bucks, found on commercial pressing equipment, require complex pneumatic supplies and generally do not have the simplicity of appliance herein disclosed.

SUMMARY OF THE INVENTION

This invention is directed to presses and more particularly to a press of relatively simplified design such as can be easily configured as a collapsible wall unit suitable for domestic, as well as small commercial use. The press incorporates two easily interchangeable bucks, each of which may cooperate with a single pressing plate. One of the bucks includes a pair of scissor like arms which, when pivoted open, can receive the sleeves of a shirt, for instance. When closed they can receive larger portions of a garment such as the yoke of a dress. The other buck includes a relatively thick central portion with a pair of thinner expansion plates which telescope into the thicker central portion. Because of the different thicknesses of the expandable buck there is, of course, an uneven surface. This unevenness is compensated for by including a cooperating heated plate having a recess corresponding to the difference in thickness. The recessed portion of the pressing plate is selected to be sufficiently wide to fully receive the scissor like buck even when it is in its open position. It is also sufficiently wide to just receive the central portion of the expandable buck. The pressing plate need not be the full length of the cooperating bucks, but rather may be significantly smaller but moveable to different positions along the bucks whereby significant reduction can be made in the power requirement for its heating elements.

DESCRIPTION OF THE PREFERRED EMBODIMENT

Figure 1:
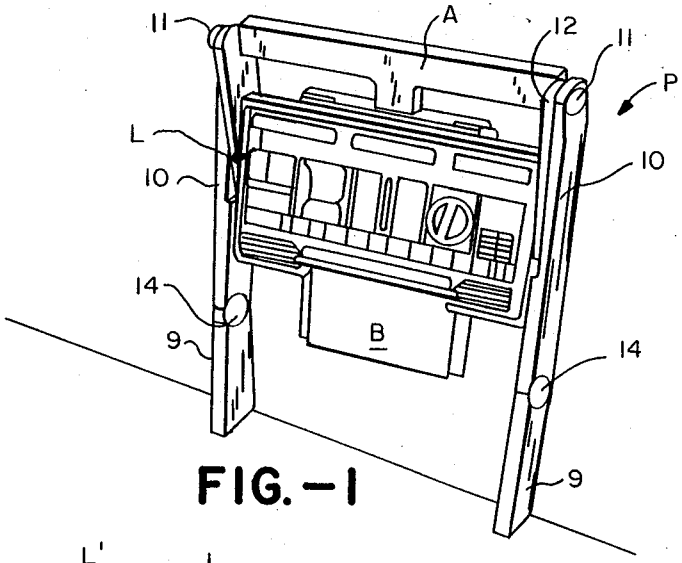
FIG. 1 is a perspective view of a press in accordance with the invention shown in a collapsed disposition illustrating both pressing plate and buck in a folded condition for convenient storage.

Referring to the drawing, the folding of the press from a storage position flush with a wall (FIG. 1) to a position of use (FIG. 4) can be understood.

The press P as shown here may be either wall mounted or floor mounted. Legs 9 are shown with their bottoms on a floor and their backs adjacent a wall. As will be understood, if wall mounting is desired, the legs need not extend to the floor. Alternatively, if floor mounting is desired the legs need not be adjacent a wall. As shown in FIGS. 1 and 2A, the press P in the collapsed position may fit flush with a wall. In the collapsed position, the various parts including a bracket A, buck B and pressing plate L are all disposed between the legs 9.

Figure 2:
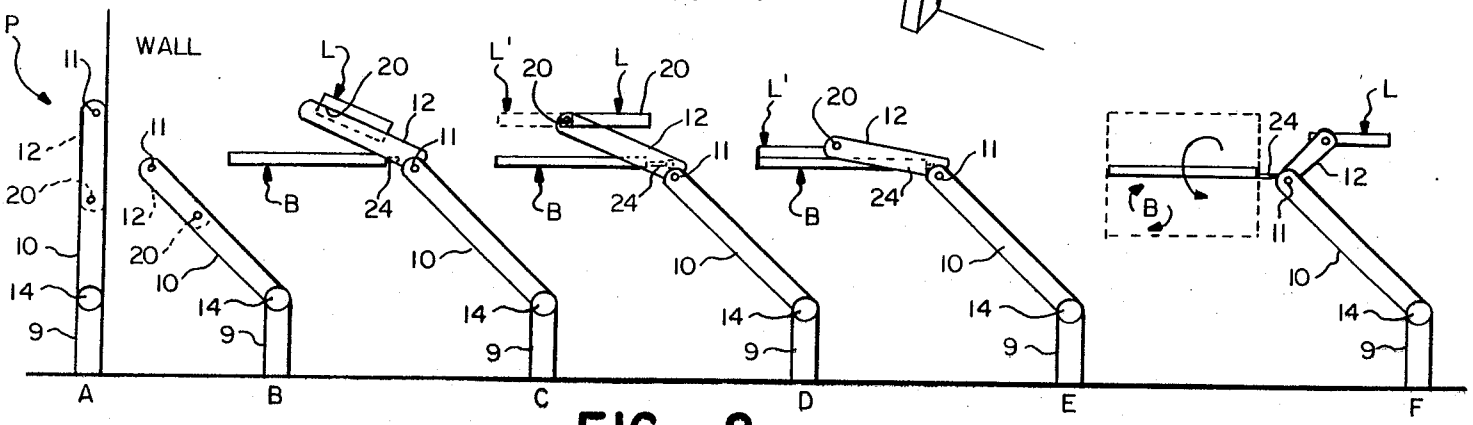
FIG. 2, A through F, are schematic drawings showing various positions of the press from its original storage position, through setup to actual pressing.
Figure 4:
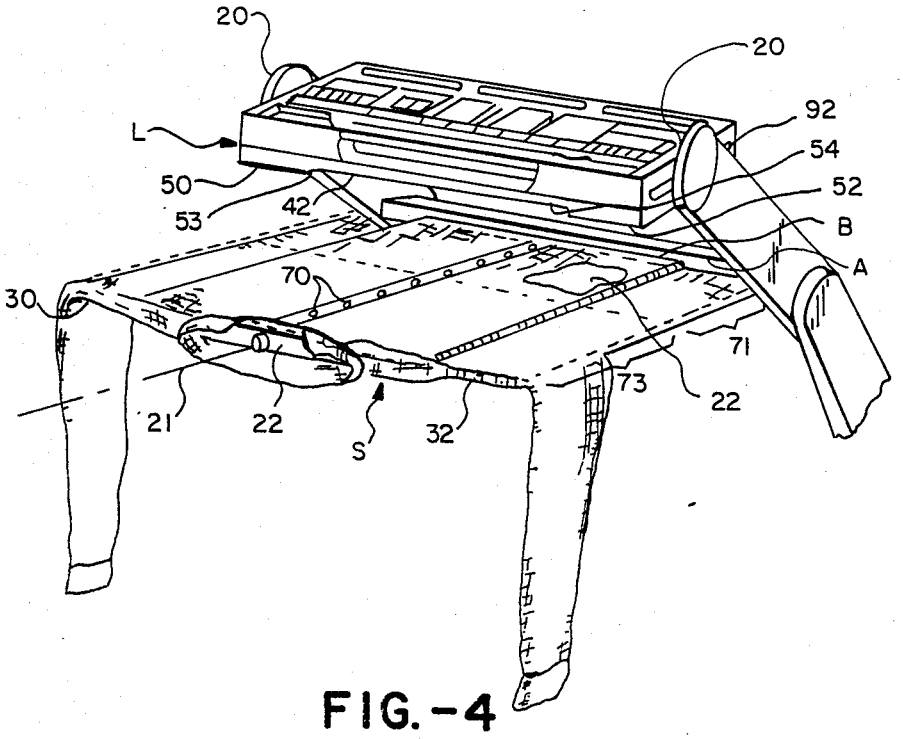
FIG. 4 is a view of the press with a garment placed over the buck.
Figure 5:
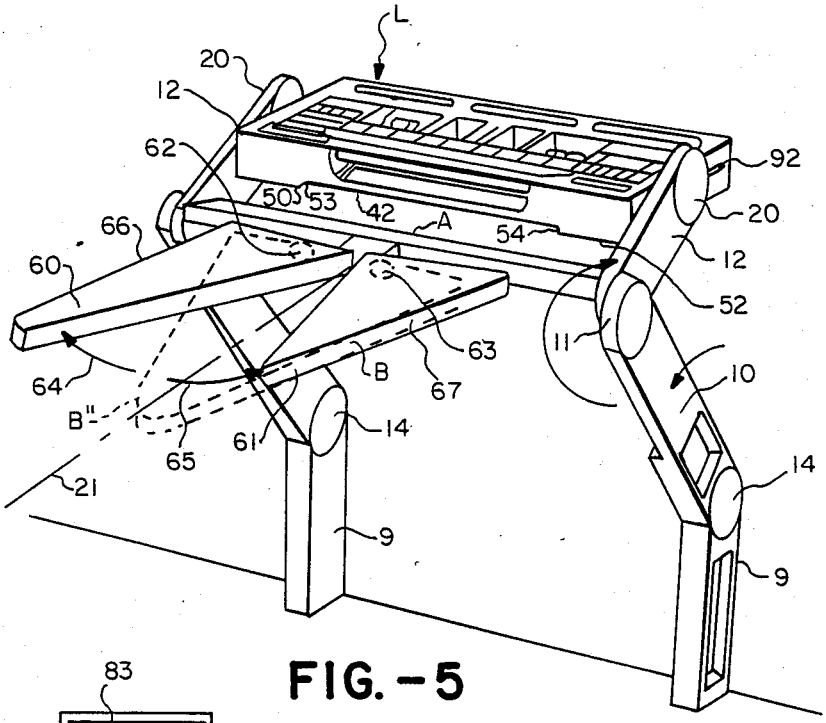
FIG. 5 is a perspective view of the press in accordance with the invention but showing a scissor type buck and the pressing plate in its withdrawn position.

Referring to FIGS. 2 and 5, it can be seen that the legs 9 support pivoting arms 10 on the top thereof at pivot joints 14. Pivots 14, with conventional locking means, permit arms 10 to move outwardly and lock at an angle of about 45°. At this angle, all further movement between arms 10 and legs 9 cease. At this position the pressing plate L and the buck B are sufficiently spaced from the wall so that they can be freely manipulated to positions as illustrated in FIGS. 4 and 5.

Figure 3:
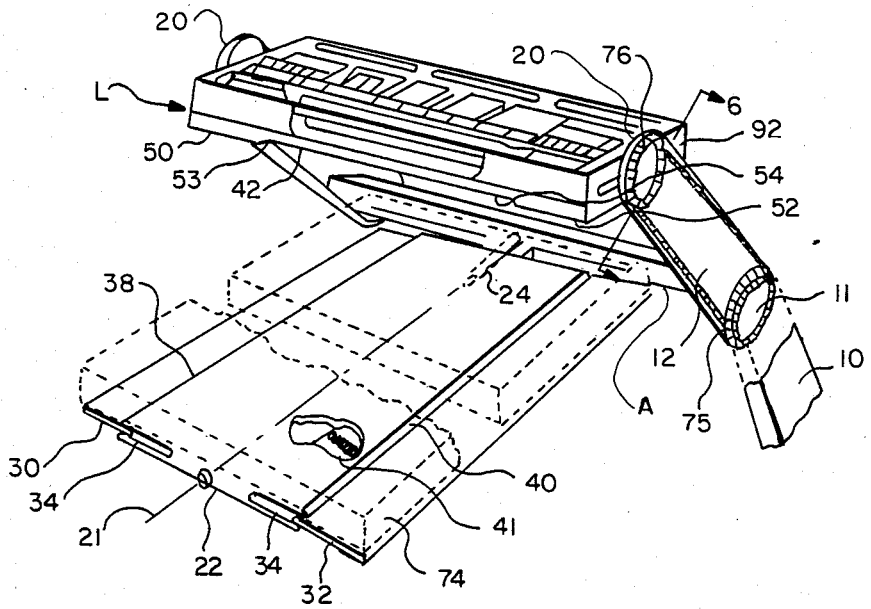
FIG. 3 is a view of the press of FIG. 1 showing the buck extended outwardly in a horizontal position with the pressing plate shown in solid lines at a position over the inner end of the buck, and in dashed lines, at a position over the outer end of the buck.

Arms 10, at their upper end, include pivot joints 11 which serve two purposes. First, the joints 11 support the bracket A bridging the two arms 10. Bracket A is rotatable about the joints 11 but is lockable at a position as shown in FIGS. 3, 4 and 5. Bracket A is the support point for buck B. Second, the same joints 11 rotatably support arms 12. One end of the arms 12 are pivoted about joints 11 for rotation to selected positions while joints 20 at the other end of the arms 12 support the pressing plate L for both slidable and limited rotatable motion.

In reaching the position shown in FIG. 2C, arms 12 pivot approximately 180° from their storage position adjacent arms 10 (see FIG. 1) to a resiliently locked position of support for pressing plate L and the buck B is raised and locked in the position shown. The pressing plate L is then rotated to the horizontal position substantially parallel to the buck B, as shown in FIGS. 2D, 3, 4 and 5. At this position the pressing plate is resiliently latched and remains, in the latched position, horizontal to the buck B regardless of the position of the arms 12, as will be seen hereinafter in conjunction with FIG. 6. In this position, pressing plate L is maintained away from buck B leaving the buck clear for placement of garments. It can thus be understood that the press disclosed is capable of movement from a flush wall mounted storage position to a position where its discrete working parts are conveniently disposed for the pressing action hereinafter set forth.

Referring to FIGS. 3 and 4, buck B includes a central major longitudinally extending member 22. Member 22 extends along a longitudinal axis 21 away from bracket A. Member 22 is held in bracket A in such a manner that it may be easily attached to or removed from the bracket. In addition, while attached to the bracket it should, upon application of manual force, be rotatable about its axis 21 but retains its rotational position when no such force is applied. One such manner of supporting the member 22 on the bracket A is to include a bore 23 in the bracket A and a corresponding stud 24 on the member 22. The dimensions of the bore 23 and stud 24 and/or their materials may be chosen to provide the aforementioned fit. As so constructed the buck B is easily placed in position or removed from the bracket A and is rotatable about its axis 21 so that either of its broad faces may be positioned upwardly.

The buck B also includes two side members 30 and 32 which are retained in telescoping relationship in slots 34 and 36 configured in the respective side edges 38 and 40 of member 22. If desired, the side members may be resiliently urged outward by means of springs 41. It will be noted that the difference in thickness between the member 22 on the one hand, and the side members 30 and 32 on the other, causes the surface of the overall buck B to be uneven at the side edges 38 and 40 of the central member 22. Thus, the surface plane of central member 22 is parallel to but spaced from the surface plane of the side members 30 and 32.

In order to diminish the effect of the buck's uneven surface, the pressing plate L, as seen in FIGS. 3 and 4, has three major pressing surfaces. A first surface 42, corresponding to the surface of the central member 22 is configured centrally of the pressing plate L. The pressing plate L also includes a pair of side pressing surfaces 50 and 52 corresponding to surfaces of the telescoping side members 3 and 32. In addition, as shown in FIGS. 3 and 4, the edges 53 and 54 in the pressing plate L comprise curved or cove like transitional surfaces between the central surface 42 and the side surfaces 50 and 52 which transitional surfaces correspond in shape and position to the rounded side edges 38 and 40 of the buck central member 22.

Referring to FIG. 5, a scissors type buck B' is illustrated. Paired triangular arm members 60 and 61 are illustrated. These members are rotatable about their respective pivots 62 and 63 towards and away from one another—as illustrated by the arrows 64 and 65. These triangular arms have two modes for utility in pressing garments.

First, the arms can be spread apart and one or both can be used together. That is to say, garments such as sleeves, trouser legs, or discrete areas to be pressed can be passed over the triangular shaped arms and pressed. Upon rotating the buck B' about the axis 21, the opposite side of the garment may be pressed.

The dimension of the buck B' is chosen such that in their spread position the side edges 66 and 67 of the arms will register with the edges 53 and 54 formed between surface 42 and surfaces 50, 52 of the pressing plate L. In such outward spread disposition, it will be understood that a portion of the garment extending around the side edges 66 and 67 will also be pressed.

In addition, the arms can be closed together as shown in dashed lines B''. In this instance, larger areas of garments such as the yoke of a dress may be used.

Referring to FIGS. 3 and 4, use of the press with the buck B can be explained using a man's shirt as an example. After at least partially buttoning the shirt with the buttons 70, the shirt is passed over the buck B with the side members 30 and 32 in their retracted position. The side members 30 and 32 are then expanded to the full girth of the shirt.

When such full expansion of the side members 30 and 32 has occurred, the heated pressing plate L is lowered onto the buck B covering an area 71 (FIG. 4). A second and overlapping pressing of the shirt can occur at area 73 (FIG. 2E and 4) with the pressing plate L in the position, as shown in FIG. 2E. Thus, with two simple motions, pressing one entire side of the shirt body is accomplished with a relatively small and economical pressing plate L.

The pressing plate L can then be moved to a position away from the buck, as shown in FIGS. 2F and 5; the buck B rotated 180° about the axis 21 and the operation repeated to complete the pressing of the shirt body.

The pressing of the press plate L onto the buck B will be seen to form a continuous pressed surface with respect to the buck. That is to say, even though the buck has been expanded by the telescoping side members 30 and 32 the entire one side of the shirt S is continually pressed.

Figure 6:
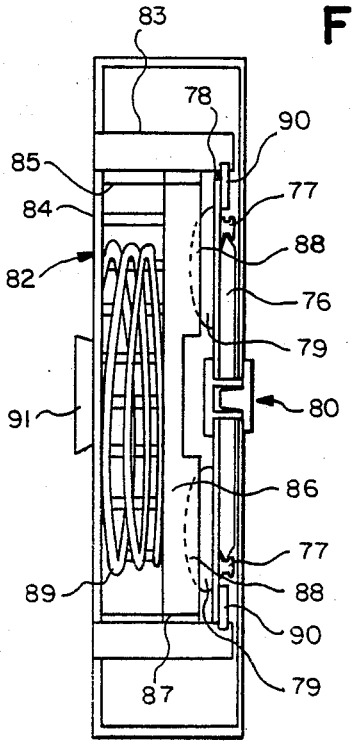
FIG. 6 is a cross sectional view along the lines 6—6 of FIG. 3 showing one of the pivotal arms of the press with one means maintaining the press plate in a position parallel to the buck but with means to overide the parallel positioning.
Figure 7:
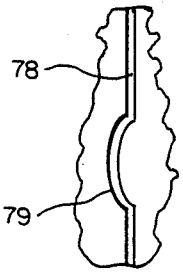
FIG. 7 is a sectional view taken along the lines 7—7 of FIG. 6.

Referring to FIGS. 3, 6 and 7 one form of mechanism is shown for maintaining the pressing plate L in a position parallel to the buck B during the pressing operation. Within the arm 12, a sprocket 75 is positioned at one end and is fixed to prevent rotation relative to the arm 10. Another sprocket 76 is rotatably positioned at the opposite end of the arm 12 and a chain 77 is passed around both sprockets 75 and 76. Fixed to the sprocket 76 is a circular plate 78 having a pair of elongated bosses 9 extending away from the sprocket 76. The entire assembly of sprocket 76, plate 78 and bosses 79 rotate freely about an axle formed by a nut and bolt combination 80.

Disposed about the plate 78 is a cup member 82 having a cylindrical side wall 83 and a back wall member 84. The interior of the cylindrical wall 83 is provided with axial grooves 85. A spline 86 having ridges 87 corresponding to the grooves 85 is disposed within the cup member. The spline 86 includes a pair of detents 88 which correspond in position and shape to the bosses 79 on the plate 78. A compression spring 89, positioned between the back wall 84 and the spline 86 urges the detents 88 into engagement with the bosses 79 when they are in alignment. A retainer ring 90 maintains the relative axial position of the cup member 82 with the plate 78. An elongated slide guide 91 is affixed to the back wall member 84 and it cooperates with a matching groove 92 on the pressing plate L thereby permitting the plate L to be moved between positions L and L', as shown in FIGS. 2D and 3.

When it is desired to apply the pressing plate L against the garment on the buck, the operator need merely push the pressing plate down to overcome the resilient force holding the arm 12 in the position shown in FIG. 2D. The consequent rotation of the arm 12 about the pivot !1, together with the non-rotation of the sprocket 75 cause the sprocket 76 to rotate thereby maintaining the bosses 79 to remain in their original attitude. With the detents 88 engaged on the bosses 79 the entire cup 82 and the pressing plate L likewise maintain the original horizontal attitude parallel to the buck B.

When it is desired to move the pressing plate out of its horizontal position for storage, application of manual rotational pressure on the plate L will urge the detents 88 off of the bosses 79.

It will be appreciated that tee disclosed buck and pressing plate is directed here to a convenient in the home appliance. Alternatively, particularly if the press is floor mounted, it may be employed as a simplified and inexpensive commercial press.

What is claimed is:

1. In a garment press having an expandable buck for coaction with a pressing plate with improvements comprising a press;

a buck including a substantially longitudinally extending central member and at least one longitudinally extending side member the surface plane of said central member being parallel but spaced from the surface plane of said side member;

said side member mounted by a means for lateral telescoping movement with respect to said central member whereby the overall width of said side member and buck can be expanded and contracted with telescoping movement of said at least one side member;

a pressing plate including means for movement of the pressing plate towards and away from said buck for pressing garments stretched over said buck;

said pressing plate defining a first surface with respect to said buck for confronting a garment stretched over said buck in pressing relationship to the surface of said central member;

said pressing plate defining a second surface for confronting the side member of said buck, said second surface enabling a garment disposed over the side member of said buck to be pressed by said pressing plate at said second surface whereby garments of varying girth placed on said pressing plate can be continuously pressed across at least one side of their girth disposed over said buck; and the surface planes of said first and second surfaces of said pressing plate being spaced from each other by an amount corresponding to the spacing between the surface plane of said central member and said side member.

2. The invention of claim 1 and wherein said buck is rotatable with respect to said pressing plate.

3. The invention of claim 1 and wherein said buck includes first and second telescoping side member.

4. The invention of claim 1 and wherein said pressing plate is movable longitudinally of said buck for pressing said buck at first and second positions.

5. In a wall mounted press for movement between a storage position flush to said wall and an operating position cantilevered out from said wall the combination comprising:

parallel legs including means for mounting the legs to said wall, flush with said wall;

first pivot means at the top of each of said first parallel legs;

first parallel arms pivotally mounted at one end to said first pivot means for movement from a disposition parallel and flush with said wall to a position pivoted outwardly away from said wall at an angle with respect to said wall;

second pivot means disposed at the opposite end of said first parallel arms, said second pivot means forming paired pivot supports comprising, a bracket pivotally connected across said pivots;

a buck mounted to said bracket including means for manual rotation of said buck relative to said bracket;

second arms pivotally mounted with respect to said second pivot members;

a pressing plate supported on the end of said second arms including means for movement of the pressing plate with said arms towards and away from said buck for the pressing of garments.

6. The invention of claim 5 wherein said buck is a split buck having first and second pivoting members, said members pivotal towards and away from one another into closed and open positions respectively.

7. The invention of claim 6 wherein:

said pressing plate defines a fixed pressing surface and two auxiliary pressing surfaces on either side thereof, said auxiliary surfaces being at a first elevation with respect to said buck and said first surface being at a spaced elevation with said buck, said first and auxiliary surfaces being interconnected by transitional surfaces having a curved cross section;

the side edges of said pivoting members in their open position being in registration with said transitional surfaces during pressing of garments.

8. The invention of claim 6 wherein said second arms include means permitting reciprocal movement of said pressing plate for pressing on different locations of said buck.

9. The invention of claim 5 wherein said buck is removably mounted to said bracket means.

10. In a garment press of the type having a rigid buck and a pressing plate, the combination comprising:

a buck disposed on said frame and having a surface adapted to receive a garment to be pressed, said surface being divided into a plurality of portions;

a pressing plate disposed on said frame and having a surface substantially smaller than the surface of said buck but slightly larger than either of said portions;

mounting means for placing said pressing plate in a position spaced from and parallel to said buck and selectively in juxtaposition with any of said portions of said buck;

and mechanism means for pivoting said pressing plate and said buck together with said garment therebetween while maintaining the parallel relationship between said pressing plate and said buck.

11. The invention of claim 10 wherein said mounting means comprises a slide connection between said pressing plate and said frame.

12. In a garment press of the type having a rigid buck and a heated pressing plate, the combination comprising a frame, a buck, a quick release coupling mounting said buck onto said frame and a heated pressing plate mounted to said frame and disposed in juxtaposition to said buck, said quick release coupling comprising a stud and bore combination, one part of said combination being mounted on said frame and the other being mounted at one edge of said buck, said combination having sufficient frictional frit to permit the buck to be rotated relative to the frame upon application of manual force.

* * * * *